United States Patent [19]

Swapp et al.

[11] Patent Number: 5,020,038

[45] Date of Patent: May 28, 1991

[54] ANTIMETASTABLE STATE CIRCUIT

[75] Inventors: Mavin Swapp, Mesa; Charles Collis, Phoenix, both of Ariz.

[73] Assignee: Motorola, Inc., Schaumburg, Ill.

[21] Appl. No.: 460,495

[22] Filed: Jan. 3, 1990

[51] Int. Cl.[5] ..... G04F 8/00; G04F 10/00

[52] U.S. Cl. ..... 368/120

[58] Field of Search ..... 368/113–120; 364/569

[56] References Cited

U.S. PATENT DOCUMENTS

| | | | |
|---|---|---|---|
| 3,983,481 | 9/1976 | Nutt et al. | 368/118 |
| 4,160,154 | 1/1979 | Jennings | 368/118 |
| 4,613,951 | 9/1986 | Chu | 364/569 |
| 4,637,733 | 1/1987 | Charles et al. | 368/120 |

*Primary Examiner*—Vit W. Miska

*Attorney, Agent, or Firm*—Joe E. Barbee; Stuart T. Langley

[57] ABSTRACT

An antimetastable state circuit which detects when a data edge is so close to a clock edge that it would result in a metastable state in a time measurement circuit is provided. When a potential metastable state is detected, the antimetastable circuit delays the data edge with respect to the clock edge by a known amount so as to avoid the metastable state. The delayed edge is used to start the time measurement circuit, and the next clock edge is used to stop the time measurement circuit. When the known delay has been added, it is subtracted from the measured time, to produce an accurate measurement of the elapsed time between the rise of the data edge and the rise of the clock edge.

12 Claims, 4 Drawing Sheets

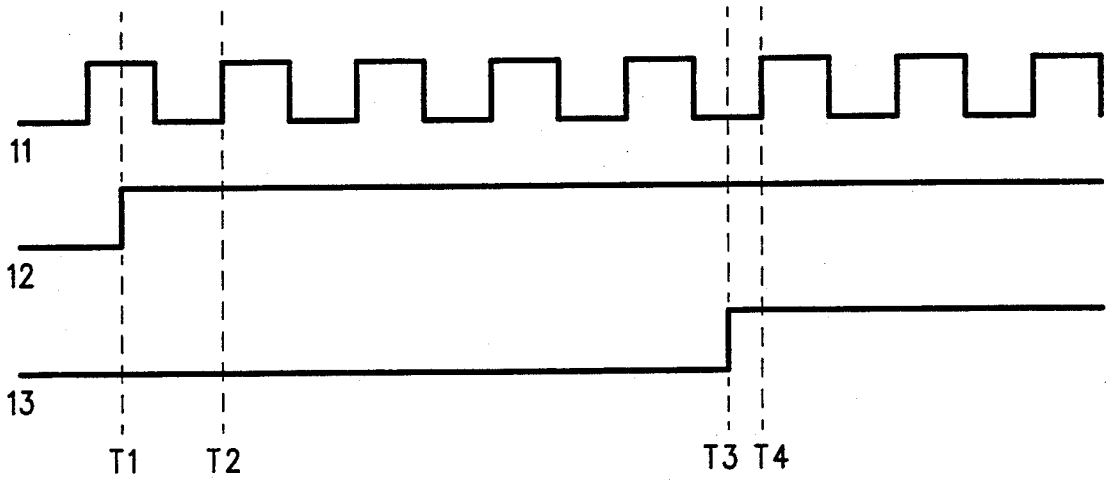
FIG. 1
FIG. 2
-PRIOR ART-
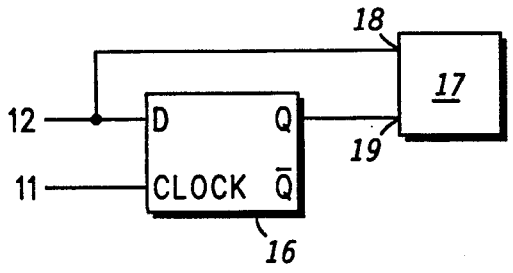

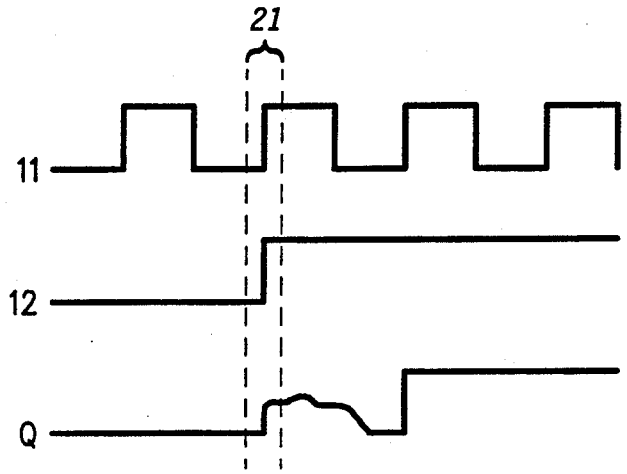
FIG. 3
-PRIOR ART-
FIG. 4
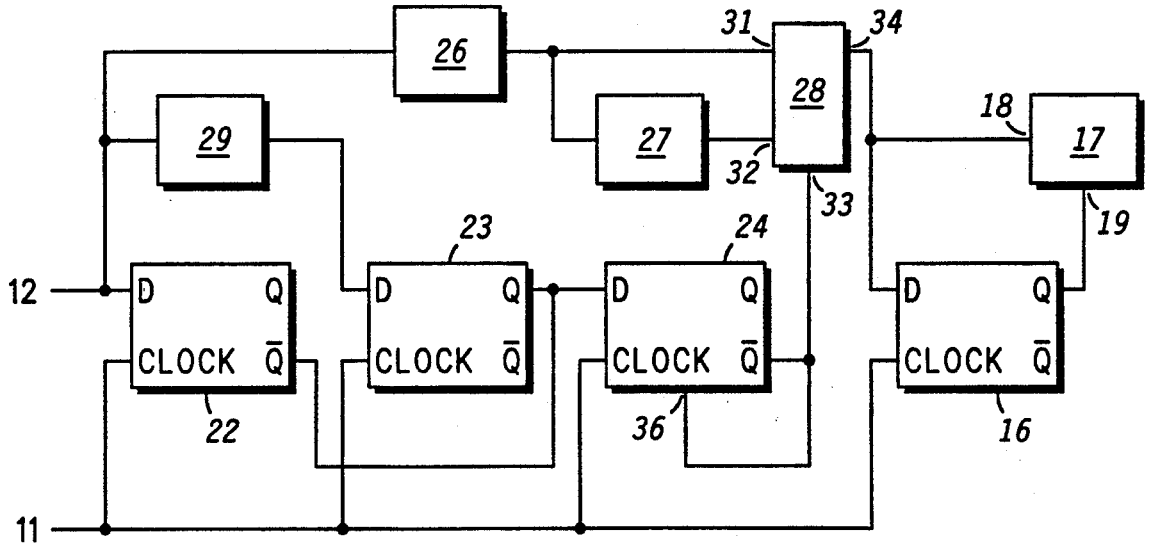

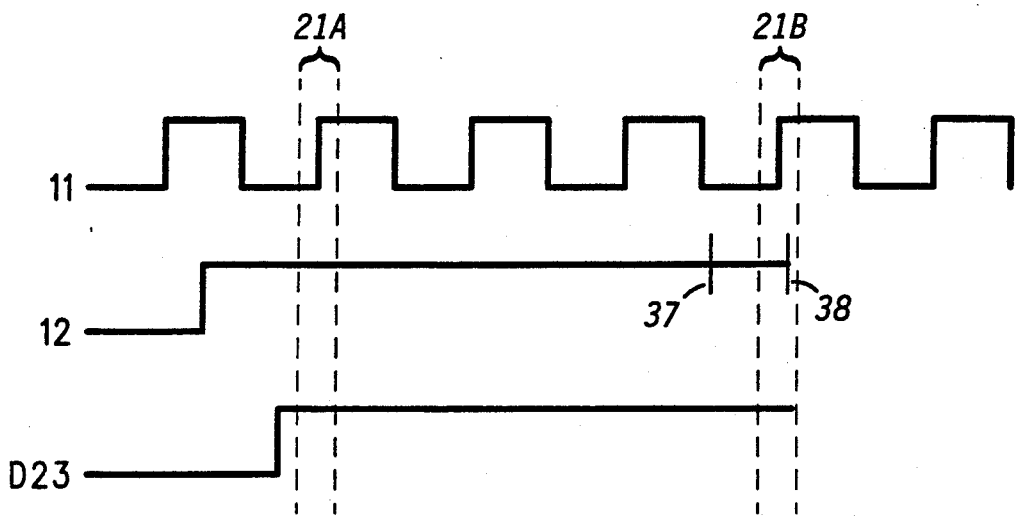
FIG. 5
FIG. 6
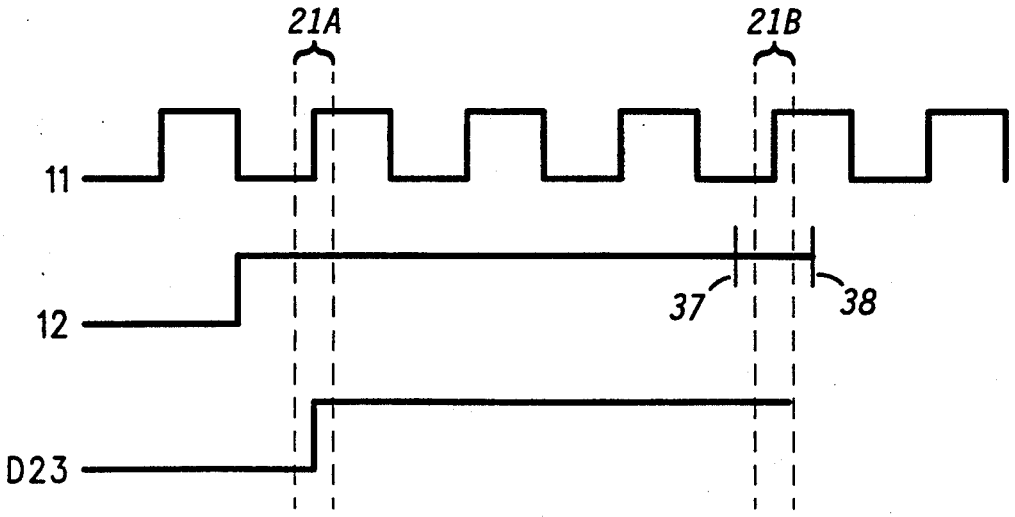

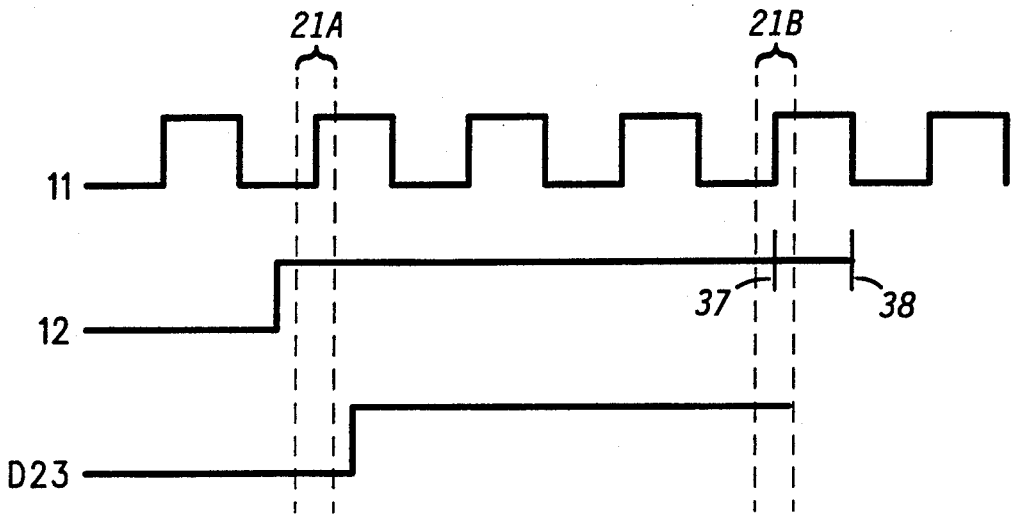
FIG. 7
FIG. 8
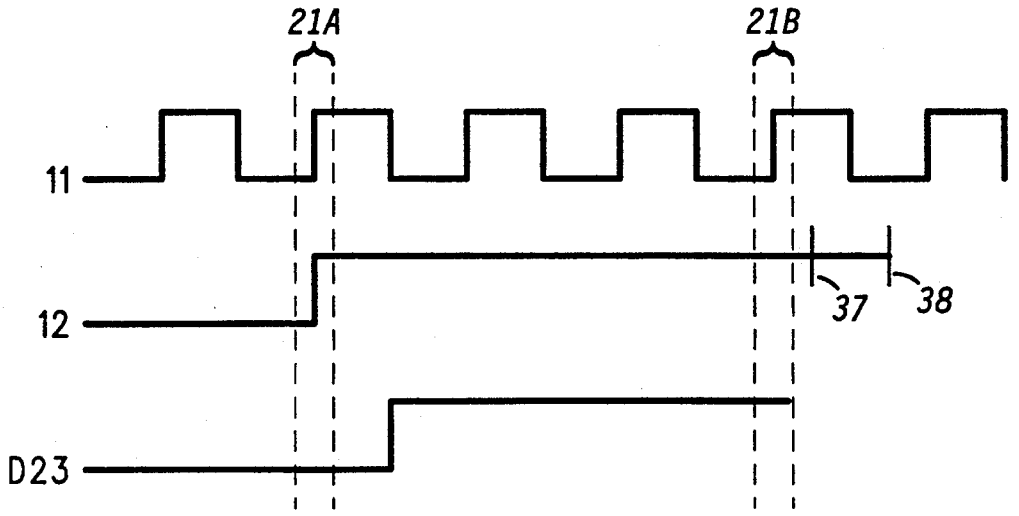

ANTIMETASTABLE STATE CIRCUIT

BACKGROUND OF THE INVENTION

This invention relates in general to time measurement circuits, and more particularly to circuits for measuring elapsed time between two asynchronous electric pulses.

The manufacture and use of electronic circuits requires that parameters such as switching speeds and gate delay times are measured accurately. Commonly, time measurement circuits produce an output that is proportional to the amount of time that passes between two events. Usually, each of these events are marked by a transition from a logic low state to a logic high state or vice-versa. Most often it is this transition, or pulse edge, which is used to trigger the time measurement circuit. The term "pulse edge" as used hereinafter is intended to encompass any transition between a logic low state to a logic high state, or vice-versa. Most logic devices recognize either a rising or falling edge of a waveform and rarely require both a rising and falling edge. Depending on the type of logic devices used, the term pulse edge can be taken to mean a rising edge, a falling edge, or a combination of the two.

A simple way of measuring time between two asynchronous pulse edges, or data edges, is to provide a clock, and count the number of clock edges which occur between the data edges. This simple method results in a crude time measurement which is limited in accuracy to the speed of the clock used. Since typical clock periods are in the order of 1 nanosecond, this method clearly cannot work for picosecond measurement accuracy.

To improve accuracy, elapsed time between each data edge, and the next clock edge must be measured. This can be done by providing a ramp circuit which has an output signal which increases linearly with time. One of the data edges is used to start the ramp circuit, while a subsequent clock edge is used to stop the ramp circuit. One such ramp circuit must be used for each of the two data edges. The ramp circuit has an analog output which is proportional to the elapsed time between the data edge, and the next clock edge. This analog data can be converted to digital data, and added to the count of clock pulses described hereinbefore. It should be noted that ramp circuits will often take several hundred or thousands of times longer to make a measurement than the actual event took. For example, if the elapsed time between the data edge and the next clock edge were 0.5 nanoseconds, a typical ramp circuit may take 500 nanoseconds to measure the elapsed time. Also, physical size of the ramp circuit is a function of the length of time which must be measured. Therefore, it is useful to minimize the time which must be measured by the ramp circuit.

In order to select the next clock edge which occurs after the data edge, a D-type flip flop is used having the data edge coupled to a data (D) input, and the clock edge coupled to a clock input. Using this arrangement, once the data edge appears on the D input, the output (Q) of the D flip flop will switch after the next clock edge comes to the clock input. Thus the Q output of the D flip flop will go high when the first clock edge after the data edge occurs. The output of the D flip flop is then coupled to the ramp circuit and is used to stop the ramp circuit.

While this basic circuit works well in theory, practical problems occur when the clock edge and data edge occur too close together. When the clock edge and data edge are so close together as to violate setup or hold time of the flip flop, the output of the flip flop will be uncertain. This uncertain output is also called a metastable state. The metastable output may or may not trigger the ramp circuit to stop. Also, propagation delay of the D-type flip flop is unknown in a metastable state, so accurate time measurement is impossible. The metastable state will eventually drift to either a logic high or logic low state, but this may take several clock periods to occur.

Circuits have been devised to reduce the occurrence of a metastable state. Commonly, a series of three or four D flip flops are used in place of the single D flip flop described above. By using three flip flops, the probability that the metastable state would reach a logic high or logic low within a clock period was greatly improved. A significant probability remained that the metastable state will be transferred through the series of flip flops, however, and eventually reach the time measurement circuit. This is increasingly probable when short clock periods were used.

To compensate for the possibility of a metastable state, several thousand measurements were usually taken, and averaged to improve accuracy. Although this method allowed the erroneous data caused by the metastable state to be averaged out, it obviously took much longer than a single measurement. Multiple measurements could actually take several milliseconds or even seconds to get an accurate measurement of an event which took only a few picoseconds. This additional time is unacceptable when many thousands or millions of measurements must be taken, as is the case for testing semiconductor integrated circuits. Also, some transient events cannot be repeated, and thus repeated measurements cannot be taken. In these cases, errors caused by the metastable state make accurate time measurement impossible.

Accordingly, it is an object of the present invention to provide a time measurement circuit with improved accuracy.

Another object of the present invention is to provide a method for measuring elapsed time in the order of a few picoseconds.

Another object of the present invention is to provide a time measurement system which reduces the time which a ramp circuit is required to measure.

Another object of the present invention is to provide a method for measuring elapsed time so accurately that multiple measurements are not necessary.

A further object of the present invention is to provide a time measurement system which removes errors caused by propagation delay change of flip flops operating in a metastable state.

SUMMARY OF THE INVENTION

These and other objects and advantages of the present invention are achieved by an antimetastable state circuit which detects when a data edge would be so close to a next clock edge that it would result in a metastable state, and delays the data edge with respect to the clock by a known amount so as to avoid the metastable state. The delayed edge is used to start a time measurement circuit, and the next clock edge is used to stop the time measurement circuit. By changing the position of the data edge with respect to the clock edge the time which must be measured by a ramp circuit is minimized.

When the known delay has been added, it is subtracted from the measured time, to produce an accurate measurement of the elapsed time between the data edge and the clock edge.

BRIEF DESCRIPTION OF THE DRAWINGS

FIG. 1 shows a timing diagram illustrating problems involved in time measurement;

FIG. 2 illustrates a portion of a prior art timing circuit;

FIG. 3 shows a timing diagram illustrating waveforms present in the circuit of FIG. 2;

FIG. 4 illustrates a schematic of an antimetastable circuit of the present invention; and FIGS. 5-8 illustrate timing diagrams for various conditions which occur in the antimetastable circuit of FIG. 4.

DETAILED DESCRIPTION OF THE DRAWINGS

FIG. 1 illustrates a basic timing diagram which illustrates the difficulty in measuring elapsed time between a first data edge 12 and a second data edge 13. The present invention will be described in reference to positive edge triggered electronics. The terms "edge" and "pulse edge" are intended to encompass any change in logic state, including rising or falling edges. Positive edge triggered electronics change state on a rising edge of a clock. Other types of flip flops and counters are known and are equally applicable to the present invention.

A task often arises in electronic circuits, particularly in semiconductor testing equipment, which requires measurement of elapsed time between two pulse edges. As shown in FIG. 1, data edge 12 begins at T1 and data edge 13 begins at T3. Clock 11 produces a rising edge on a regular cycle which typically has a period of about one to ten nanoseconds. The antimetastable circuit will be described with reference to a one nanosecond clock, although it should be understood that any clock period is applicable.

T1 and T3, as illustrated in FIG. 1, occur asynchronously with clock edge 11. That is to say, T1 and T3 do not always coincide with a rising clock edge, although coincidence is possible. A crude approximation of time between T1 and T3 can be made by counting clock edges 11 between T1 and T3. This approximation would result in a measurement accuracy of plus or minus one clock period. To obtain a more accurate measurement of elapsed time it is necessary to measure the difference in time between T1 and a next clock edge which occurs at T2, as well as T3 and the next rising clock edge at T4. Thus, the problem of accurately measuring elapsed time between asynchronous edges at T1 and T3 boils down to a problem of measuring elapsed time between a first interval T1 to T2 and elapsed time between a second interval T3 to T4. The time between T2 and T4 can be easily measured by counting clock edges. The methods and apparatus for measuring the first and second interval are identical, and so will be described in reference to the first interval only. It should be understood, however, that the circuitry shown in FIG. 2 and FIG. 4 would be duplicated to measure the second interval.

The interval measurement can be done using a ramp circuit 17 as shown in FIG. 2. Ramp circuit 17 outputs an analog output which is a function of elapsed time between a start signal received on start input 18 and a stop signal received on stop input 19. This analog output can be converted to a digital output which can be added and subtracted from other measurements. For the waveform shown in FIG. 1, one ramp circuit 17 must be provided to measure the time elapsed between T1 and T2, and another ramp circuit provided to measure the time elapsed between T3 and T4. In order to measure the elapsed time between T1 and T2 shown in FIG. 1, data line 12 should be coupled directly to start input 18 while stop input 19 must be coupled to the next clock edge which occurs after data appears on data line 12. Flip flop 16 serves to select the next clock edge at T2. Flip flop 16 is a D-type flip flop which transfers data which is on a data (D) input to an output (Q) when a rising edge of a clock signal is present on a clock input. The D flip flop also has a differential output ($\overline{Q}$) which has the opposite logic value from the Q output.

Data edge 12 is coupled to the D input of flip flop 16 and to start input 18, clock 11 is coupled to the clock input of flip flop 16, and the Q output of flip flop 16 is coupled to stop input 19. In this arrangement, data edge 12 starts ramp circuit 17. When the next clock edge 11 appears at the clock input of flip flop 16 the Q output goes high. The logic high output shuts off ramp circuit 17 and the analog output from ramp circuit 17 represents elapsed time between T1 and T2 shown in FIG. 1. A propagation delay of flip flop 16 is added to the elapsed time between T1 and T2, but so long as this propagation delay is constant, it can be compensated for.

As illustrated in FIG. 3, when data input on data line 12 and a clock edge 11 coincide, the Q output of flip flop 16 can go into an indeterminate or metastable state. Data edge 12 and clock edge 11 do not have to be exactly coincident as any data edge 12 during metastable window 21 which surrounds a clock edge may result in a metastable state. Metastable window 21 results because every flip flop has setup and hold time conditions which, if violated, result in a metastable output. The metastable output, illustrated by the Q waveform in FIG. 3, will vary between a logic low and a logic high indeterminately and may eventually settle into a logic state. There is no guarantee, however, that a logic state will be reached within a single clock period, nor any guarantee that the eventual logic state will be a correct one. Also, since the propagation delay of flip flop 16 is indeterminate in the metastable state, it cannot be compensated for even when a correct logic state is reached.

FIG. 4 illustrates an antimetastable circuit of the present invention. Ramp circuit 17 and flip flop 16 are analogous to the elements shown in FIG. 2. The circuit shown to the left of flip flop 16 serves to precondition data edge 12 so that a metastable condition on flip flop 16 is impossible.

Start input 18 is coupled to an output 34 of multiplexer 28. A signal on control input 33 of multiplexer 28 selects between inputs 31 and 32 and places the selected input on output 34. Input 31 is coupled to data edge 12 by a "short" data path. This short data path has a programmable delay 26 which preferably delays data edge 12 by 3.25 clock periods. Data input 32 is coupled to what is called a "long" data path and incorporates an additional delay 27 which is preferably about one-half clock period. Delay 27 should be at least as long as metastable window 21 shown in FIG. 3, and is preferably the same length as delay 29, described later. Data input 31 is selected when a logic low is present on control input 33 and data input 32 is selected when a logic high is present on control input 33. For ease of description, any propagation delay through multiplexer 28 has been lumped into delay 26 as well as any delay associated with transmission lines or coupling between components. Because delay 26 is programmable, it can be easily calibrated to take into account the additional delays.

As described, multiplexer 28 serves to select from either a 3.25 nanosecond delay or a 3.75 nanosecond delay when a one nanosecond clock period is used. Thus, a data input edge 12 will appear at ramp start input 18 and at the D input of flip flop 16 either 3.25 nanoseconds or 3.75 nanoseconds after appearing at the D input of flip flop 22. As will be seen, the selectable delay is used to position data edge 12 so that a metastable condition cannot result at flip flop 16.

Flip flops 22–24 and delay 29 serve to test the relationship between data edge 12 and clock edge 11 and output a signal to multiplexer 28 to correct data edge 12 when a metastable condition would exist at flip flop 16. Clock 11 is coupled to the clock input of each of flip flops 22–24, as well as flip flop 16. The D input of flip flop 22 is coupled directly to data edge 12 while the D input of flip flop 23 is coupled to data edge 12 through delay 29. Delay 29 is conveniently selected to be one-half clock period although it is only necessary that delay 29 be longer than metastable window 21 for the flip flop, shown in FIG. 3. With a 1 nanosecond clock, delay 29 will be 0.5 nanoseconds. Typically, a 0.5 nanosecond delay adds about a 200% guard band around metastable window 21. When a data edge appears at the D input of flip flop 22, it will appear at the D input of flip flop 23 0.5 nanoseconds later. The $\overline{Q}$ output of the flip flop 22 is coupled to the Q output of flip flop 23 and to the D input of flip flop 24. The coupling between the $\overline{Q}$ output of flip flop 22 and the Q output of flip flop 23 is commonly called a "hardwire or" and results in the D input of flip flop 24 being at the highest logic level of either the $\overline{Q}$ output flip flop 22 or the Q output of flip flop 23.

The $\overline{Q}$ output of flip flop 24 is coupled to a reset input 36 of flip flop 24. When reset input 36 receives a logic high, the clock input of flip flop 24 is disabled and the $\overline{Q}$ output of flip flop 24 goes to a logic high. By coupling the $\overline{Q}$ output to its own reset 36, a positive feedback loop is created whereby a metastable signal on the $\overline{Q}$ output will tend to turn on reset 36 thus disabling the clock input of flip flop 24 and forcing the $\overline{Q}$ output to a logic high from the metastable state. Once reset input 36 is latched to a logic high state, any edges which occur at the D input of flip flop 24 will not affect the outputs. This is important in that the D input of flip flop 24 will remain in a logic low state for at most one clock period, so the output of flip flop 24 must be latched to guarantee a stable output even when the D input of flip flop 24 changes. The $\overline{Q}$ output of flip flop 24 is also coupled to control input 33 of multiplexer 28.

Once the positive feedback loop has latched the $\overline{Q}$ output of flip flop 24 into a logic high, circuit operation will need to be restored by providing a logic signal to a set input (not shown) of flip flop 24. The set input may also be needed to initialize flip flop 24 when the antimetastable circuit is first turned on. Flip flop 24 should be of a type which has a set input which overrides reset input 36. One such flip flop is part number MC10E131 manufactured by Motorola Inc.

The operation of the antimetastable circuit shown in FIG. 4 is most easily understood by looking at the waveforms shown in FIGS. 5–8 which illustrate the antimetastable circuit function with various relationships between data edge 12 and clock edge 11. FIG. 5 illustrates a condition where data edge 12 occurs more than one-half clock period before metastable window 21A. The waveform labeled D23 illustrates the waveform seen at the D input of flip flop 23, and so is delayed by 0.5 clock period by delay 29 shown in FIG. 4. Hash mark 37 on data edge 12 waveform illustrates the time at which data edge 12 would arrive at the D input of clock 16 when the short data path is used while hash mark 38 indicates the time it would arrive when the long data path is used. If data edge 12 arrives within metastable window 21B, flip flop 16 can enter a metastable state. It is this condition which is to be avoided by the antimetastable circuit.

In the case illustrated in FIG. 5, where both data edge 12 and delayed edge D23 arrive before metastable window 21A, the $\overline{Q}$ output of flip flop 22 will be forced to a logic low while the Q output of flip flop 23 will be forced to a logic high. Thus the D input of flip flop 24 will be at a logic high and the $\overline{Q}$ output of flip flop 24 will be forced to a logic low. In this case the short data path is selected. As shown in FIG. 5, it is indeed the short data path which should be selected to avoid metastable window 21B.

FIG. 6 illustrates waveforms when data edge 12 comes before metastable window 21A but delayed edge D23 comes during metastable window 21A. This condition results in the $\overline{Q}$ output of flip flop 22 being at a logic low while the Q output of flip flop 23 would enter a metastable state. Thus the D input of flip flop 24 sees a metastable state. It should be noted that by looking at hash marks 37 and 38 that in this condition it doesn't matter whether a short data path or a long data path is chosen as neither path will result in a metastable condition on flip flop 16. It is important, however, that one or the other of the data paths be chosen in order to avoid time measurement error. Referring to FIG. 4, a subsequent clock edge will force the metastable state on the D input of flip flop 24 to be transferred to the $\overline{Q}$ output of flip flop 24. As described hereinbefore, the positive feedback loop will tend to force the $\overline{Q}$ output to a logic high. Often, this will occur before the next clock edge, and thus a logic high will appear on control input 33. Even if this does not occur, the next clock edge will force the $\overline{Q}$ output to a logic low because by this time the D input of flip flop 24 has stabilized at a logic high. If this happens the short data path will be chosen. In either case, the data path will be chosen well before the data arrives at multiplexer 28 thus protecting the integrity of the data which is presented at flip flop 16.

FIG. 7 illustrates a relationship between data edge 12 and clock edge 11 which must result in the long data path being chosen. Here, data edge 12 comes before metastable window 21, while delayed edge D23 falls after the window. This results in the $\overline{Q}$ output of flip flop 22 as well as the Q output of flip flop 23 being forced to a logic low. Thus, the $\overline{Q}$ output of flip flop 24 goes high forcing multiplexer 28 to select the long data path. As can be seen in FIG. 7 when this relationship exists between data edge 12 and clock edge 11, indeed a long data path 38 should be chosen. The positive feedback loop formed by coupling the $\overline{Q}$ output of flip flop 24 to reset 36 serves to hold the $\overline{Q}$ output at a logic high until flip flop 24 is reinitialized. Without the positive feedback loop shown in FIG. 4, the $\overline{Q}$ output of flip flop 24 would change to a logic low, before data edge 12 arrived at multiplexor 28.

FIG. 8 illustrates a condition similar to that shown in FIG. 6 but in this case the metastable state on the D input of flip flop 24 is caused by flip flop 22. The antimetastable circuit functions similarly to ensure that multiplexer 28 selects a data path well before it is needed although it doesn't matter which data path is selected. It should be noted that although flip flops 22–24 may enter a metastable state, their propagation delays are not added to either the data edge or the clock edge, and thus to not effect the accuracy of the time measurement circuit. Only flip flop 16 is in the data path, and since it cannot enter a metastable state, no measurement error will occur.

It should be noted that the circuit shown in FIG. 4 serves to place data pulse 12 in a range of 0.25 to 0.75 clock periods from the next clock edge 11. Thus, ramp circuit 17 will never be required to measure a time which is outside of this range. The size of this range is the same as delay 29 and delay 27. Flip flops 22 and 23, together with delay 29, serve to detect a window which is as wide as delay 29. If additional flip flops and delays are used which are coupled and function analogously to flip flops 22 and 23 and delay 29, additional windows can be detected. In this manner, data edge 12 can be placed in smaller and smaller ranges with respect to the next clock edge 11, greatly reducing the time which ramp circuit 17 is required to measure.

By now it should be appreciated that a circuit and method for measuring elapsed time between two asynchronous edges is provided. By testing the relationship between the two edges, a metastable state can be avoided before the edges are used in a time measurement circuit. In this manner, greater accuracy can be achieved by the measurement circuit, and it becomes possible to accurately measure events with only a few picosecond duration. It is believed that accuracy of plus or minus five picoseconds can be achieved in a single measurement using a one nanosecond clock period. By eliminating the need for multiple measurements, time required for measuring events is greatly reduced, resulting in a time measurement system which can be efficiently used for integrated circuit testing.

We claim:

1. A method for measuring time between two asynchronous pulse edges comprising the steps of: providing a time measurement circuit coupled to first and second edges; testing the first edge with respect to the second edge to determine if the edges would cause a metastable state in the time measurement circuit; and delaying the first edge by a predetermined amount if a metastable state would exist.

2. The method of claim 1 wherein the first edge is a data edge and the second edge is a clock edge.

3. The method of claim 1 further comprising the steps of: delaying the first edge by a first amount when a metastable condition does not exist and by a second amount when a metastable condition would exist.

4. A method of measuring elapsed time between a data edge and a clock edge comprising the steps of: providing a time measurement circuit; generating first and second delayed edges from the data edge, wherein the first and second delayed edges are separated by a predetermined length of time such that at least one of the delayed edges is not coincident with the clock edge; determining which of the delayed edges is not coincident with the clock edge; and coupling the delayed edge which is not coincident with the clock edge to the time measurement circuit.

5. The method of claim 4 wherein the time measurement circuit comprises a flip flop and the predetermined length of time is longer than set up and hold time for the flip flop.

6. A circuit for measuring time difference between a data signal and a clock signal comprising: a first flip flop having a data input coupled directly to the data signal; a first delay line having a predetermined time delay coupled to the data signal; a second flip flop having a data input coupled to the first delay line, wherein a $\overline{Q}$ output of the first flip flop is coupled to a Q output of the second flip flop; a third flip flop having a data input coupled to the Q output of the second flip flop and the $\overline{Q}$ output of the first flip flop, wherein the first, second, and third flip flops have clock inputs coupled to the clock signal; a multiplexer having two data inputs, an output, and a control input for selecting between the two data inputs, wherein the control input is coupled to a $\overline{Q}$ output of the third flip flop; a second delay line coupling the data signal to one of the multiplexer data inputs; a third delay line coupling the data signal to another of the multiplexer data inputs, wherein the third delay line is longer than the second delay line; and a time measurement circuit coupled to the output of the multiplexer and the clock signal.

7. The circuit of claim 6 wherein the third flip flop has a reset input which disables the clock and data inputs and forces the $\overline{Q}$ output to a logic high state, and the $\overline{Q}$ output is coupled to the reset input.

8. The circuit of claim 6 wherein the flip flops are D-type flip flops.

9. The circuit of claim 6 wherein the flip flops have a characteristic set up and hold time, and the predetermined time delay of the first delay line is longer than this set up and hold time.

10. The circuit of claim 6 wherein the third delay line is longer than the second delay line by the predetermined time delay.

11. The circuit of claim 6 wherein the clock signal has a 1 nanosecond period, the first delay is approximately 0.5 nanoseconds, the second delay is approximately 3.25 nanoseconds, and the third delay is approximately 3.75 nanoseconds.

12. A time measurement circuit comprising: a means for detecting a metastable window coupled to first and second pulse edges; a means for programmably delaying the first pulse edge with respect to the second pulse edge which is controlled by the means for detecting a metastable window; and a ramp circuit having a start input coupled to the means for programmably delaying the first pulse and a stop input coupled to the second pulse edge.

* * * * *